United States Patent [19]

Mitchell

[11] 3,968,602

[45] July 13, 1976

[54] PROTECTIVE WORKMAN AND EQUIPMENT COVERS

[76] Inventor: Frank L. Mitchell, 4929 S. Troost, Tulsa, Okla. 74105

[22] Filed: Jan. 24, 1975

[21] Appl. No.: 543,874

[52] U.S. Cl. ..... 52/40; 52/649; 52/697; 182/92; 182/47

[51] Int. Cl.[2] ..... E04H 12/00; E04C 3/30

[58] Field of Search ..... 52/27, 220, 221, 19, 52/20, 40, 36, 240, 648, 649, 721, 697; 182/222, 228, 221, 223, 189, 90, 100, 108, 230, 92, 47

[56] References Cited

UNITED STATES PATENTS

| | | | |
|---|---|---|---|
| 1,002,051 | 8/1911 | Fessenden | 52/40 |
| 1,617,626 | 2/1927 | Fitzgerald | 52/27 |
| 1,687,449 | 10/1928 | Hill | 52/649 |
| 1,963,014 | 6/1934 | Brown | 52/649 |
| 2,717,275 | 9/1955 | Hayden et al. | 52/27 |
| 2,804,951 | 9/1957 | Kolt | 52/648 |
| 2,991,118 | 7/1961 | Sleger | 182/90 |

*Primary Examiner*—Ernest R. Purser
*Assistant Examiner*—Robert Farber
*Attorney, Agent, or Firm*—Blair & Brown

[57] ABSTRACT

Protective covers for workmen and equipment including a ground or pedestal type terminal cover fabricated to protect ground and pedestal type terminals and the cable connections connected therewith against weather, moisture, water and etc. A sealed enclosure rests on the ground and encompasses the terminal ends of buried cables and conduits, the enclosure having easily accessible opening panels for access to the ends of the electrical cables but offering extensive protection to these cables when the enclosure is fully filled. A sectional pole system is mounted atop the enclosure to provide support for above ground cables that are brought to the pole and admitted to the enclosure and its associated terminals. Also included is a portable easily assembled boxlike unit which may be folded flat for transport, may be set over material and equipment and also used as protection for workman.

5 Claims, 32 Drawing Figures

7

43
57
CAP
INVERTED
7
59
59
57
58
57
58

58
57
53
45
45
4
4
49
41
48
42
42
51
52
50
42
47

FIG. 4.
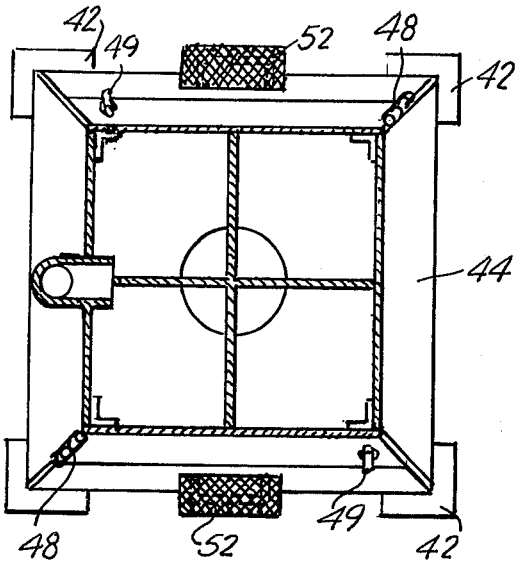
FIG. 5.
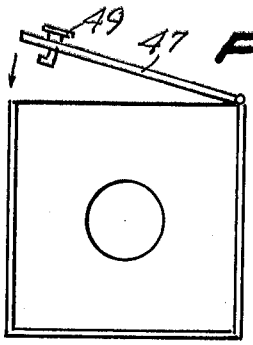
FIG. 6.
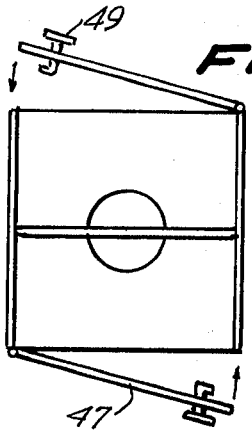
FIG. 7.
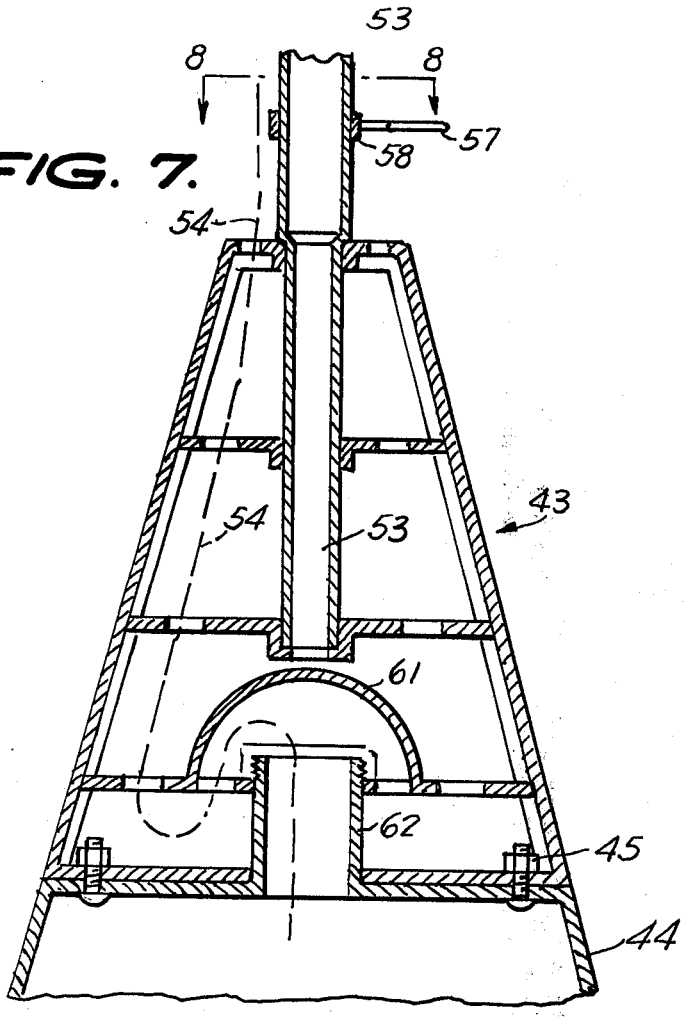
FIG. 8.
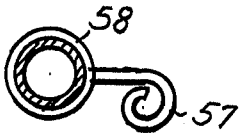
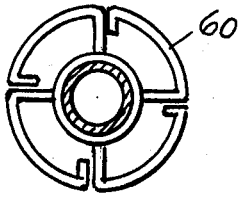
FIG. 9.

FIG. 13.
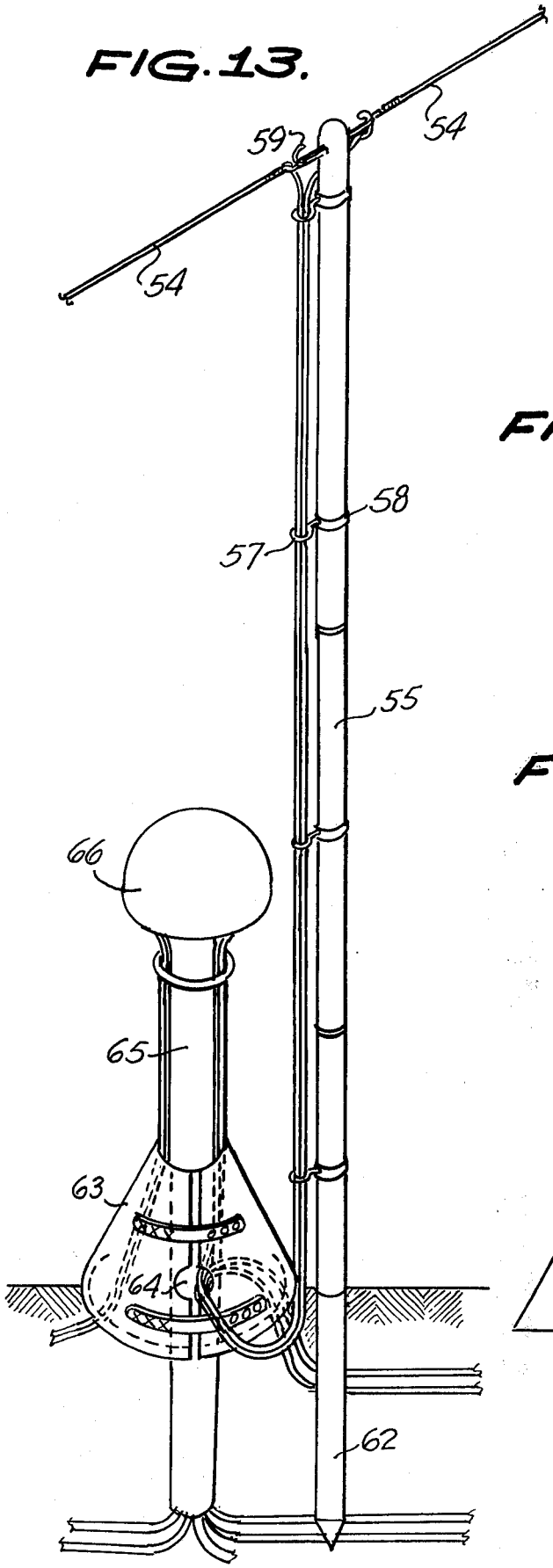
FIG. 14.
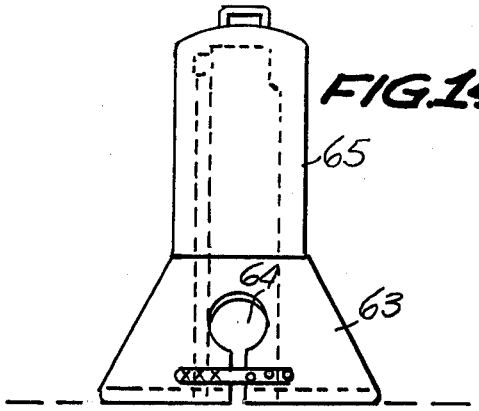
FIG. 15.
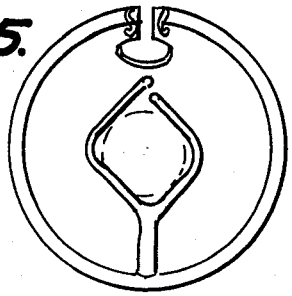
FIG. 16.
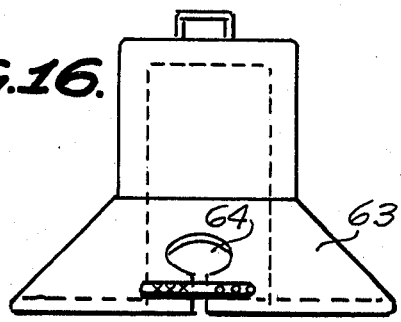
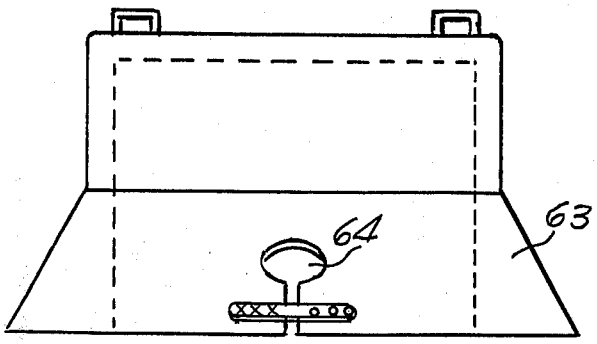
FIG. 17.

FIG. 27.
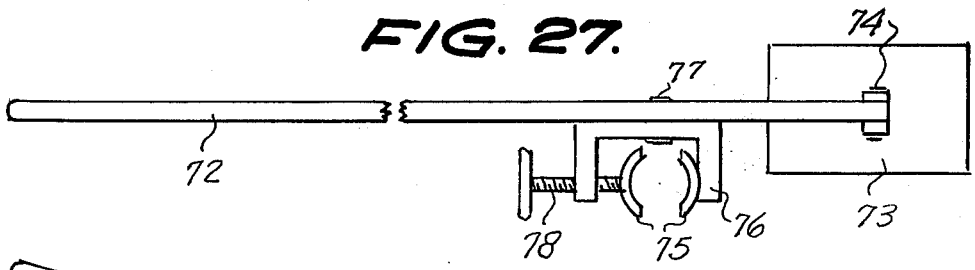
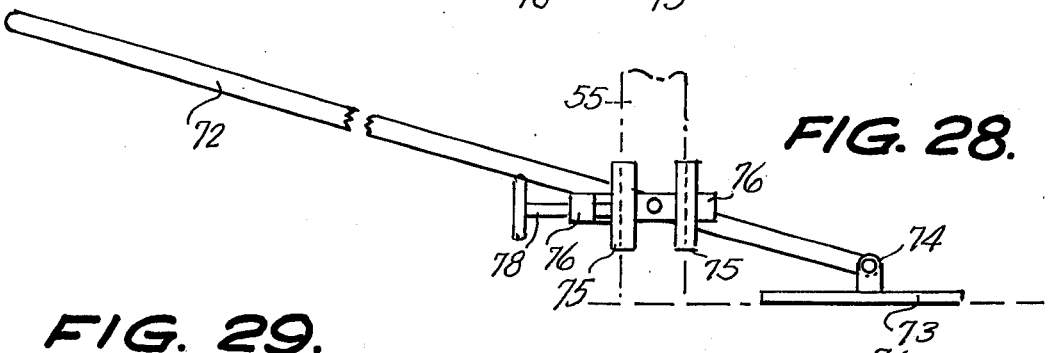
FIG. 28.
FIG. 29.
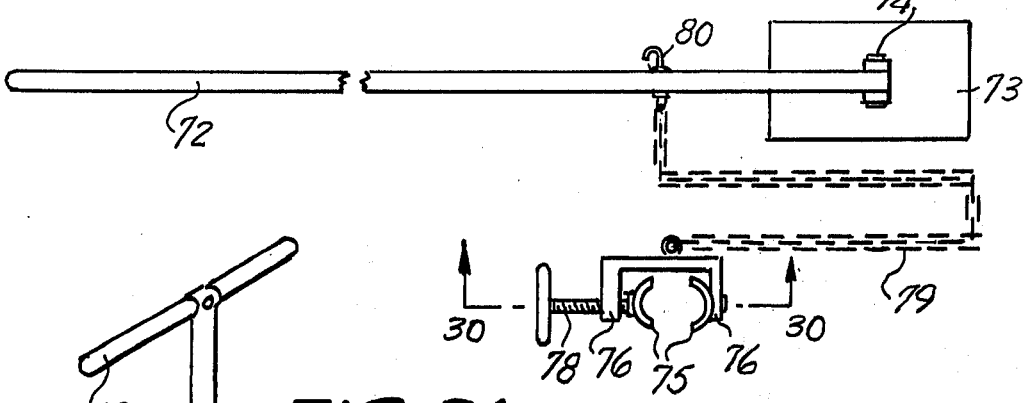
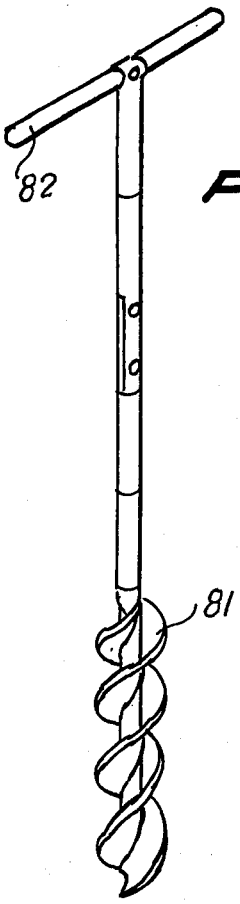
FIG. 31.
FIG. 30.
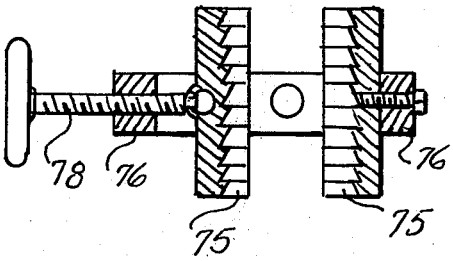

PROTECTIVE WORKMAN AND EQUIPMENT COVERS

BACKGROUND OF THE INVENTION

1. Field of the Invention

The present invention relates to protective covers as used for equipment and workman.

2. Summary of the Invention

The present invention of protective covers for pedestal type cable terminals, and for personnel, includes a four leg tapering tower arrangement which may be located over the ground terminals of buried service cables and conduits. There being a water proof enclosure part of the way up the tower which actually houses the ends of the cables, in a terminal formation. The cable terminations are readily accessible to working personnel and may house a plurality of cable terminations, all tagged and identified, and protected against weather, water, snow and etc. The tower arrangement also has at its upper portion a pole for receiving above ground cables which may also be brought into the water tight enclosure for further connection to the underground cables. Detachable panels are provided to give access to the cable ends so that working personnel may easily service the terminals.

The primary object of the invention is to provide protective covers for ground and pedestal type terminals in the form of working personnel and equipment covers.

Other objects and advantages will become apparent in the following specification when considered in light of the attached drawings.

BRIEF DESCRIPTION OF THE DRAWINGS

FIG. 4 shows a view looking along the lines 4—4 of FIG. 2;

FIGS. 5 and 6 show plan views of the manner for mounting the access doors to the enclosure;

FIG. 7 shows an embodiment of the enclosure with means for bringing in cables and connecting to buried conduits;

FIG. 8 shows a view taken along the line 8—8 of FIG. 7;

FIG. 9 shows a plan view of one type of cable mountings which is attached to the pole;

FIG. 13 shows an embodiment of a protective cover for both underground and above ground cables;

FIGS. 14, 15, 16 and 17 shows various embodiments of the protective covers;

FIG. 27 shows a plan view of an attachment for removing the pole section from the ground;

FIG. 28 is an elevational view of the pole remover shown in FIG. 27;

FIG. 29 shows another embodiment of the pole removing accessary;

FIG. 30 is a detailed view of the device as it holds onto the pole; and

FIG. 31 shows a ground auger for digging the hole for inserting a pole.

DESCRIPTION OF THE PREFERRED EMBODIMENT

Figure 1:
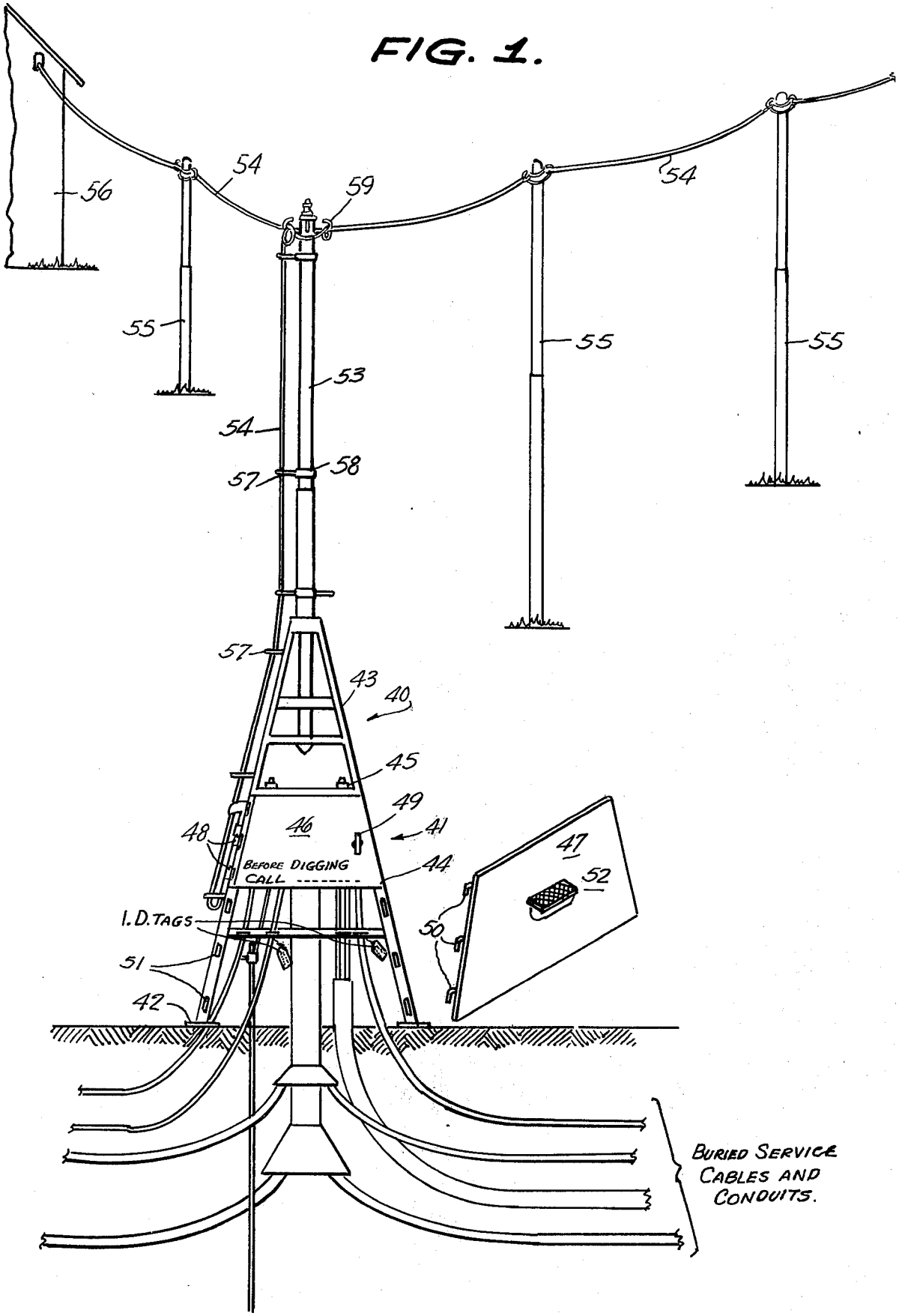
FIG. 1 shows an elevational view of a cable tower providing a protective enclosure for the cable terminals.

Referring now to the drawings in detail wherein like reference characters indicate like parts throughout the several figures, the reference numeral 40 indicates generally a tower arrangement incorporating therein an enclosure indicated generally as 41. The tower 40 has four legs and horizontal feet 42 which rests on the surface of the ground. The base part of the tower 40 includes an upper section 43 which is bolted to a lower section 44 by means of a plurality of bolts 45.

The lower section of the tower, as indicated as 44 and as described above includes the water proof protective enclosure 41, is provided with an upper and lower detachable panels shown as 46 and 47 respectively. The upper panel 46 is mounted with hinges 48 and a rotatable latch 49 to lock it in place. The lower panel 47 is secured by means of hooks 50 attached to its inner side, these hooks 50 meeting with recesses 51 in the legs of the tower. It may be noted that lower panel 47 is also provided with a step 52 to assist personnel that have to climb the tower. It should be obvious from the view of FIG. 1 how a tower 40 with its protective enclosure 41 may be located above the terminal endings of buried service cables and conduits and thereby acting as the protection for these terminals.

The upper section 43 of the tower, which is bolted to the lower section 44 serves as a support and anchoring means for a pole 53, having attached thereto an above ground service cable 54. Often above ground cables must be utilized for telephone, cable television, and the like where it is impossible to employ below ground conduits and in these cases the cable is stretched along a plurality of ground poles 55 for attachment to an ultimate user as at 56. When it is necessary for cable 54 to be brought into protective enclosure 41 the cable is stung along parallel with pole 53 and held in place by stand off spacers 57 and finally brought into enclosure 41 for ultimate attachment to the cable termination.

Figures 2, 3:
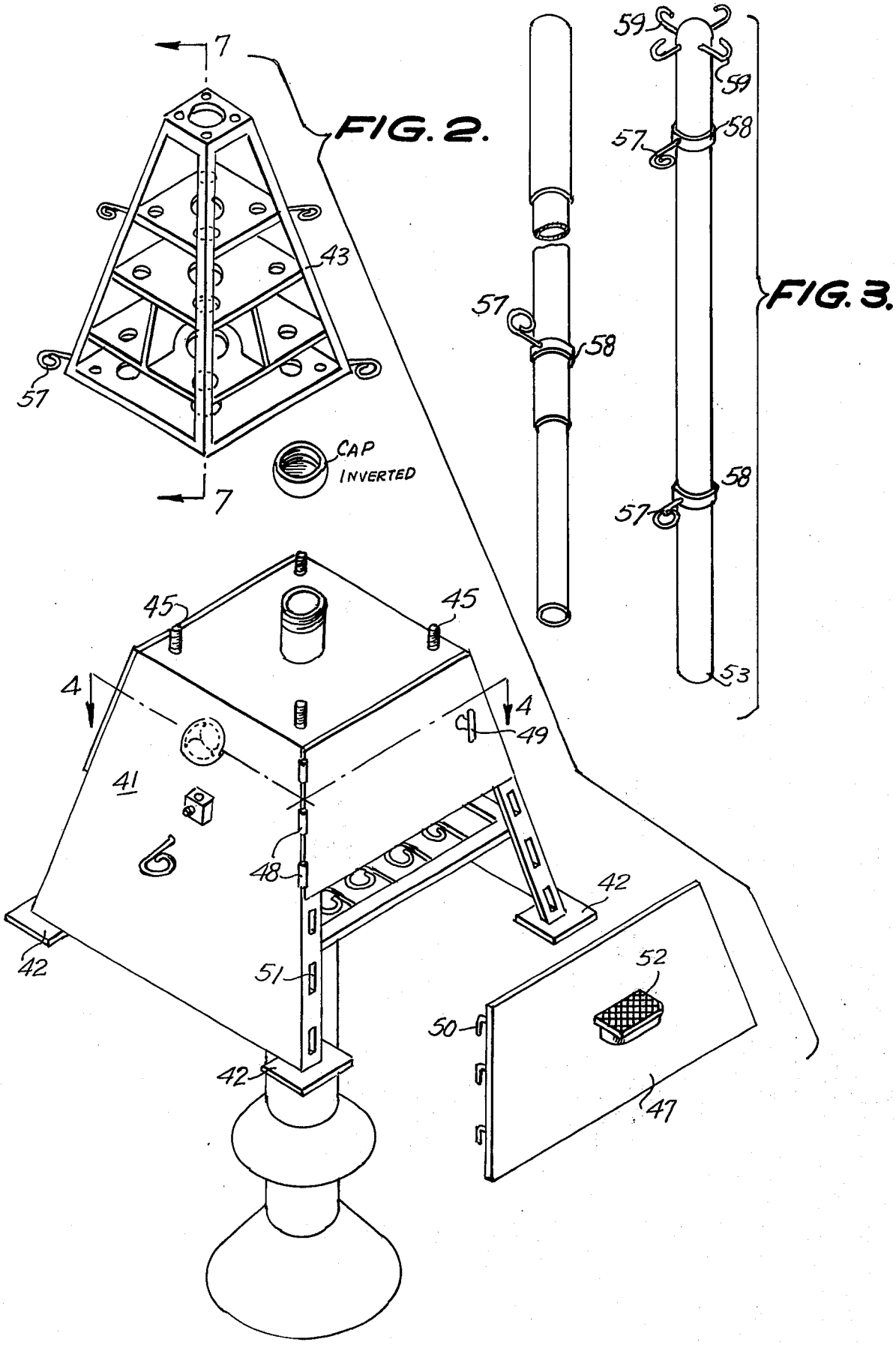
FIG. 2 shows an exploded view of the tower base.
FIG. 3 shows a view of the pole placed atop the tower with its open ring connections for attaching cables thereto.
Figure 10:
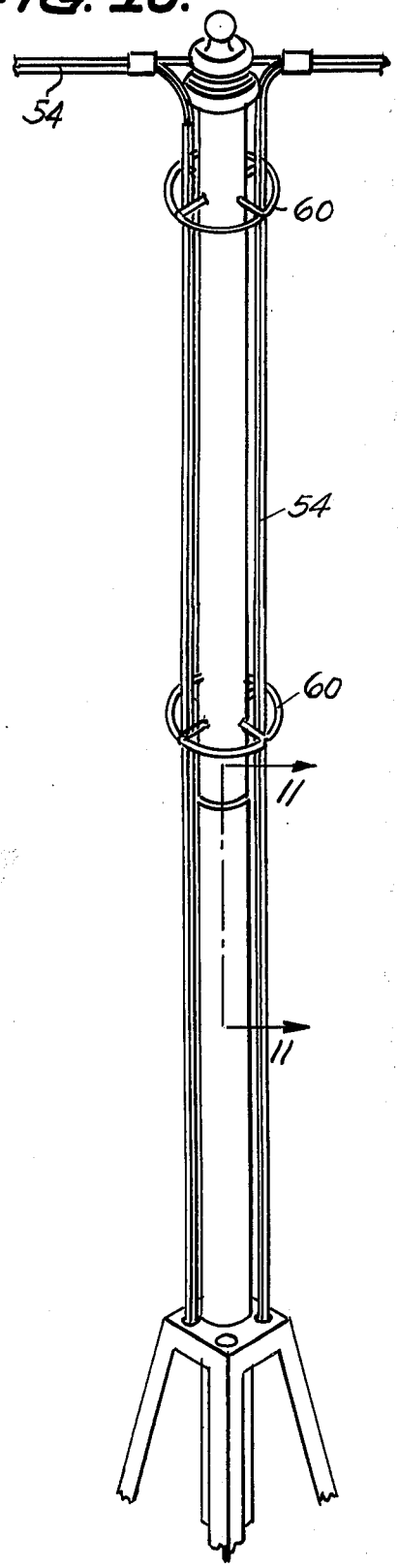
FIG. 10 shows one embodiment of the pole for holding above ground cables.
Figure 11:
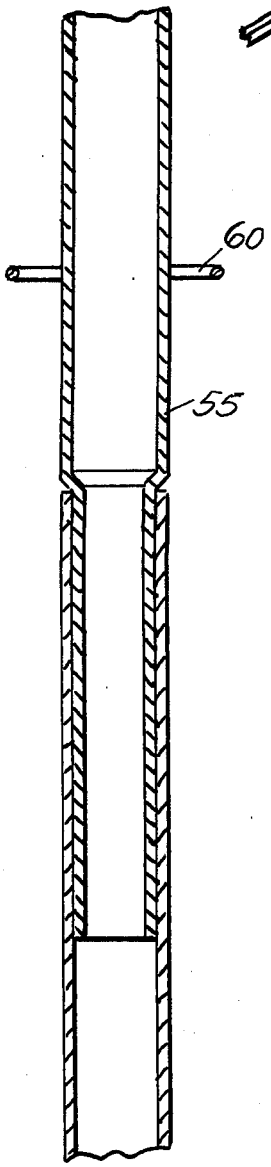
FIG. 11 shows a section taken along the lines 11—11 of FIG. 10.
Figure 12:
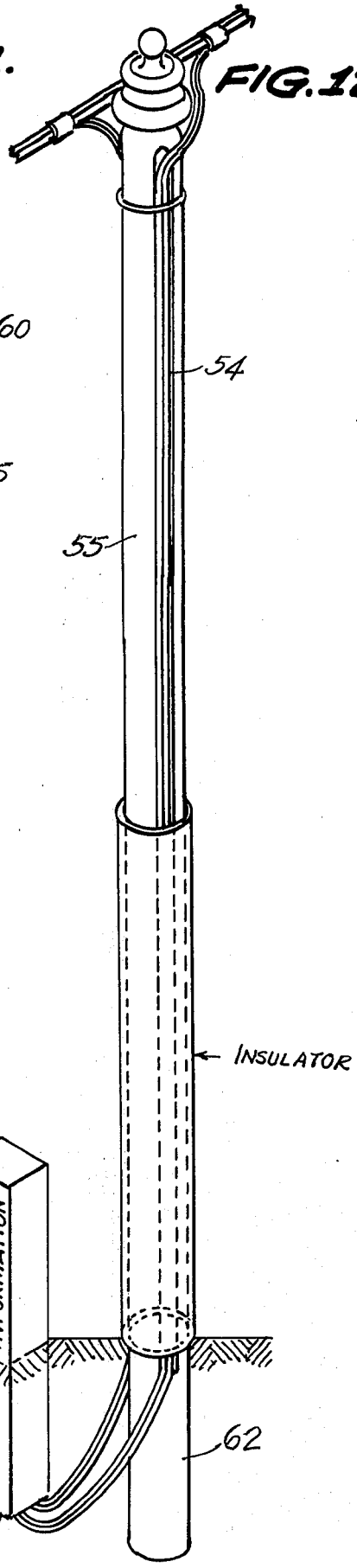
FIG. 12 shows a pole mounting for handling above ground cables and their connection to a pedestal terminal.
Figure 12A:
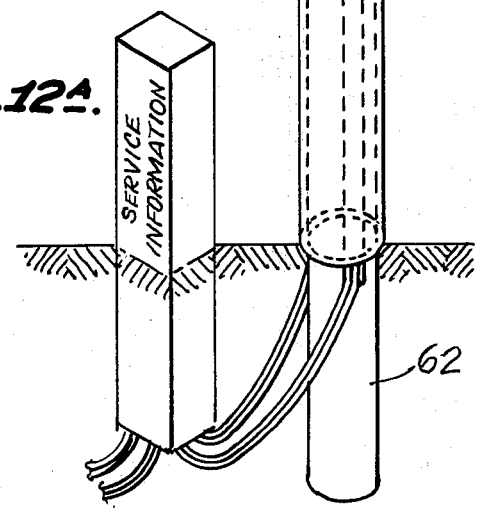

It may be noted at this point that the stand off hooks 57 take on several configurations. In one form a collar 58 is attached to the pole 53 or 55, the collar being used as a support for a closed wire loop through which an incoming cable is strung. Another form of hook better shown in FIG. 3 and used at the top of poles 55 comprise an open end U-shaped form of support, bearing numeral 59. Still another form of cable support, and better shown in FIGS. 9 and 10, comprise a complete metal ring attached to the pole, the ring being divided into quadrants and having the cable threaded therethrough.

Turning briefly to FIG. 7 there is shown an enlarged clarified view of an alternate means for bringing service cable into the protective enclosure 41. Here the cable 54 and shown in dotted lines is brought in through an opening in the top part of the upper section 43, is threaded through holes in the cross brace members of the section and finally threaded upward through a dome-shaped piece 61 before again reversing directions and going down through a pipe 62. The pipe 62 forms a passageway between the upper section 43 and the enclosure lower section 44 and fits the upper end of the pipe 62 is covered by the dome-shaped members 61 there is provided a highly efficient water proof entrance into the enclosure 44.

Both the poles 54 located atop the tower 40 and also the poles 55 for above ground use are conveniently made in sections as shown in FIGS. 10, 11, 23, 24, 25 and 26. The lower half of each section is made into a tapering portion of lesser diameter than the upper end of the next section so that these sections may be added together to give a pole of any desired height. Below the bottom most section of the pole there may be employed a heavy gauge pointed section 62 which is driven into the ground and which is adaptable for sealing the lower section of the pole for support.

Sometimes an above ground supported cable 54 must be joined and connected to buried cables below the ground and some form of pedestal terminal resting on the ground, and a typical arrangement is shown in FIG. 13. A sectional ground pole 55 is inserted into the heavy gauge pointed pipe 62 to be held into the ground while the cable 54 is brought down parallel with the post through hooks 57 and down to a cone-shaped protective covering 63 at ground level. The cable 54 is then carried through a hole 64 in the protective covering and dotted lines show how this cable along with underground cables are brought up through the circular shank 65 of the pedestal and underneath a dome 66 where the cables are spliced together or joined as required. By this arrangement all of the connections and splicing is adequately protected under a water proof weather proof dome arrangement 66 and is free from water.

Figure 18:
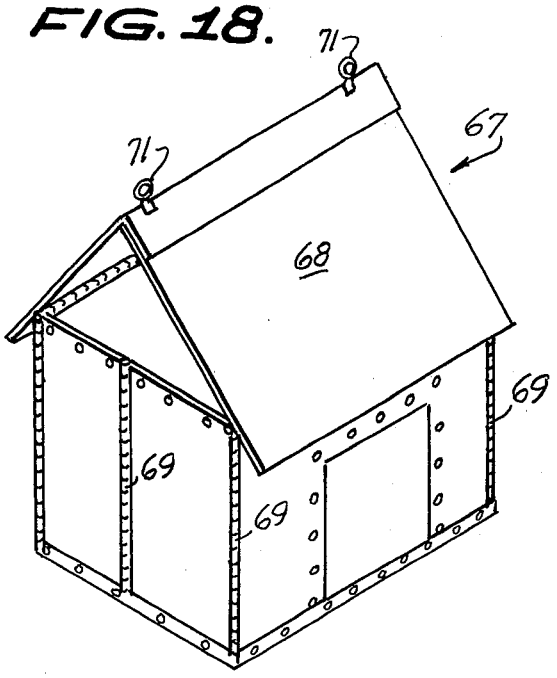
FIG. 18 shows a protective housing for working personnel.
Figure 19:
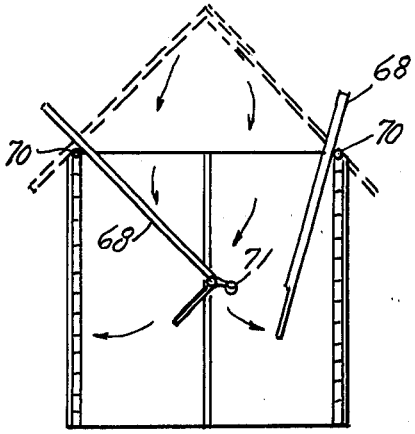
FIG. 19 shows the manner in which the roof of the personnel protector is hinged so that the structure may be folded.
Figure 20:
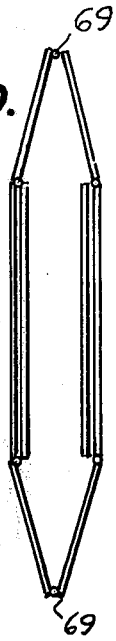
FIG. 20 shows how the side walls fold outward when the structure is being collapsed.
Figure 21:
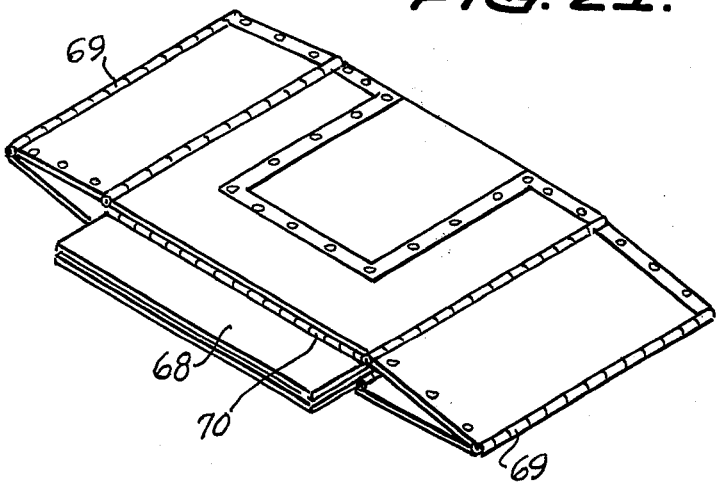
FIG. 21 shows the personnel protector fully folded into a flat configuration.
Figure 22:
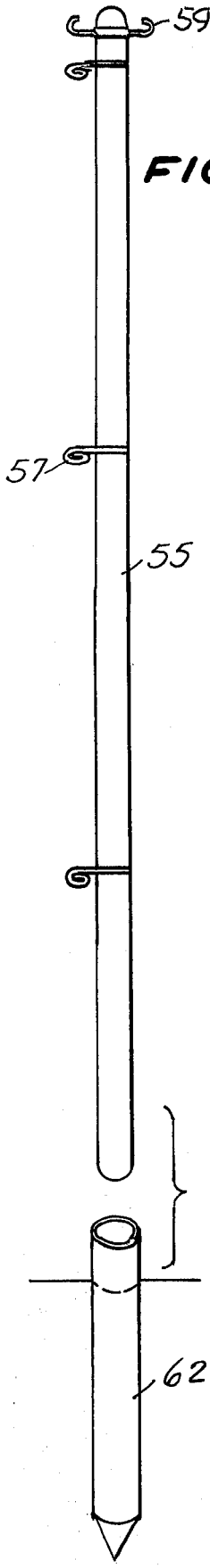
FIG. 22 shows a configuration of a above ground pole support and the manner in which it is placed in the ground.
Figure 23:
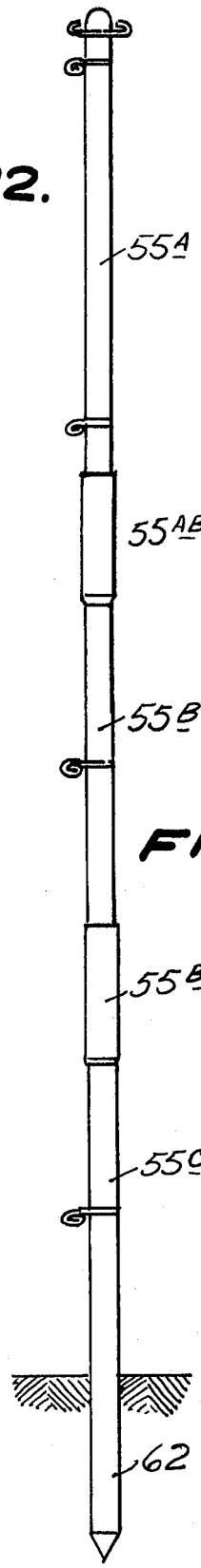
FIG. 23 shows a sectional type above ground pole.
Figure 24:
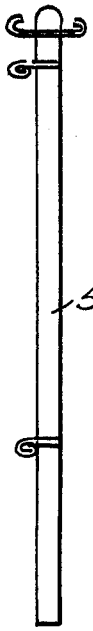
FIGS. 24, 25 and 26 shows the pole sections separated.
Figure 25:
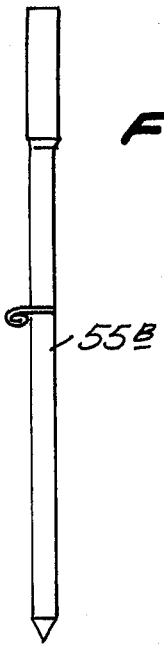
Figure 26:
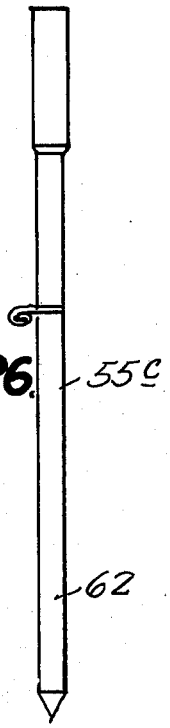

A portable workman's protective covering is shown in FIG. 18 while structured to inable that it can be folded into a flat configuration is better shown in FIGS. 19, 20 and 21. The workman's protective covering, indicated as 67, has a slanting roof panel 68 along with hinges 69 placed in each of its corners and in the center of the two end sections. The roof panels 68 are hinged at point 70 along the top of the side sections and locking tabs 71 project up through the apex turn of one of the panels 68. It may be noted further that there is no flooring in the protective coverings 67 so that when the roof panels are pivoted about 70 as shown in FIG. 19 and the end panels are also pulled out about there hinges 69 then the entire enclosure structure will assume the position of FIG. 20 and finally assume a perfectly flat configuration as shown in FIG. 21.

As mentioned here in above, and as shown in FIGS. 22 through 26 the ground poles 55 may be either in the form of a single pole or a plurality of interfitting sections to make the pole as tall as desired. Thus, the poles 55 may comprise a top section **55*a* a middle section 55*b* and a bottom section 55*c*, the lower portion of each section being somewhat smaller in diameter so that it will fit into the larger upper section of the following portion. Thus sections 55*a* and 55*b* are joined together at 55*ab* and sections 55*b* and 55*c* are joined together at section 55*bc*. Each of the bottom sections of the pole are then inserted into a heavy gauge pointed pipe 62** which has been driven into the ground.

Should the need arise that the ground poles 55 have to be removed from the ground there is provided a pole extractor accessory as shown in FIGS. 27, 28 and 29. A long handle 72 is connected to broad ground contacting plate 73 by means of a pivot connections 74. A short distance up the handle 72 from pivot 74 there is mounted a pair of adjustable jaws 75, one of the jaws being attached to a U-shaped clamp 76 the clamp being pivotally mounted at 77 to the handles 72 and the other jaw being adjustable by means of a screw member 78. It may be observed that the U-shaped clamp 76 has sufficient distance between its arms so that when screw members 78 is backed away sufficiently to move its jaw members 75 then ground pole 55 will fit between the two jaws. Screw member 78 is turned until the jaws 75 tightly grip the ground pole 55 and due to the tremendous mechanical advantage exerted on the jaws 75 when the long handle 72 is raised upward there is sufficient force exerted on the ground pole 55 to pull it out of the ground. A modification of this pole pulling accessory may be obtained by the use of a short length of chain 79 connected between the long handle 72 and U-shaped mounting 76 this being shown in FIG. 29. An open ended hook 80 may be used at the connection of the chain and arm 72 as a means for carrying the chain and jaws when they are being ported from one location to the other. Furthermore, the jaws 75 may well have a plurality of graduated teeth on their inner faces as shown in FIG. 30 to thereby improve contact between posts 55 and the jaws.

In order to assist in the erection of ground poles 55 there is provided an auger having spiral plates 81 and a handle to turn these plates 82 to facilitate digging a hole of the proper diameter in the ground.

In the use and operation of the invention to finish protective covers for workmen and equipment a tower 40 may be placed near the emergent connections buried cables and conduits, the tower 40 having a central water proof enclosure 41 to protect all cable terminations from the bad effects of weather, water and etc. The base of the tower 40 has detachable panels 46, 47 to provide easy access to the cables when work should be done thereon. The upper half of the tower 43 is used to support a pole 53 to finish support for above ground cables 54 supported by ground posts 55 and to bring these cables 54 into enclosure 41 for connection to the other cables found therein. Poles 53 and 55 may be made in sections to provide an adjustable height where needed and by use of stand off hooks 57 or complete ring support 60 the cables 54 are securely mounted along the poles 53 and brought to a pedestal terminal or other weather protected covering. For working personnel there is provided a protective covering 67 in the form of a small enclosure which is portable and erected or dismantled into a perfectly flat structure for ease of transportation. For the ease of removing ground poles 55 there is further provided a jacking accessory having a ground mounting plate 73 and a long handle 72 which is used to jack the pole up out of the ground. The pedestal type terminal covers and also those for protection of working personnel, as disclosed by the invention are made of durable weather resistant materials and provide a highly effective protection against weather, water and other corrosion causing effects.

Having thus described the preferred embodiment of the invention it should be understood that numerous structural modifications and adaptations may be resorted to without departing from the spirit of the invention.

What is claimed is:

1. Equipment and personnel protection means comprising a tower, said tower being placed near the emerging position of underground buried cables and conduits, ground contacting feet for supporting the tower, a lower completely enclosed, bottom half of the tower with side panels and a horizontal top panel midway up the tower sealed to the side panels, an open work upper half of the tower connected to the lower section, and cable supporting means mounted on the upper half of the tower.

2. The device of claim 1 wherein the bottom half of the tower has a lower, completely removable, without hinges, panel to provide access to the buried cables, and also a foot step attached to the center of the panel on the outside.

3. The device of claim 2 wherein the bottom half of the tower has an upper, hinged panel and latch for providing access to and weather protection for the terminals of the buried cables.

4. The device of claim 3 wherein the cable supporting means comprises a pole mounted on the upper half of the tower for supporting above ground cables.

5. The device of claim 4 further including a plurality of hooks attached to the pole for guiding above ground cables to the enclosed bottom half of the tower and through the upper hinged panel, for connection with the buried cables.

* * * * *